United States Patent [19]

Iwai et al.

[11] 4,408,917

[45] Oct. 11, 1983

[54] PAPER GUIDE MECHANISM IN A PRINTER

[75] Inventors: Hiroji Iwai, Yamatokoriyama; Hirotoshi Matsui, Nara, both of Japan

[73] Assignee: Sharp Kabushiki Kaisha, Osaka, Japan

[21] Appl. No.: 346,188

[22] Filed: Feb. 5, 1982

[30] Foreign Application Priority Data

Feb. 9, 1981 [JP] Japan ..... 56-17496[U]

[51] Int. Cl.[3] ..... B41J 13/048

[52] U.S. Cl. ..... 400/637.2; 400/647

[58] Field of Search ..... 400/637, 637.1, 637.2, 400/637.3, 637.4, 637.5, 637.6, 639.1, 639.2, 647, 578

[56] References Cited

U.S. PATENT DOCUMENTS

| | | | |
|---|---|---|---|
| 1,992,562 | 2/1935 | Zlabek | 400/637.2 X |
| 3,581,861 | 6/1971 | Bellis | 400/637.2 X |
| 3,966,037 | 6/1976 | Zambolin | 400/637.2 X |
| 4,275,969 | 6/1981 | Matsuhisa et al. | 400/639.1 X |

*Primary Examiner*—Edgar S. Burr
*Assistant Examiner*—Moshe I. Cohen
*Attorney, Agent, or Firm*—Birch, Stewart, Kolasch and Birch

[57] ABSTRACT

A paper guide mechanism in a printer includes a platen and a plurality of paper feed rollers for setting a paper sheet around the platen. A plurality of slidable guide plates are disposed below the platen adjacent to the paper feed rollers. The upper surfaces of the slidable guide plates are shaped to accomodate the surface of the platen. To set the paper sheet around the platen, the slidable guide plates are shifted along the surface of the platen so that the slidable guide plates are protruded toward the front portion of the platen in order to ensure an easy setting of the paper sheet. When the paper setting operation is completed, the slidable guide plates are returned to the normal position so as not to disturb the printing operation.

4 Claims, 5 Drawing Figures

PAPER GUIDE MECHANISM IN A PRINTER

BACKGROUND AND SUMMARY OF THE INVENTION

The present invention relates to a paper sheet guide mechanism in a printer such as an ink jet system printer and a typewriter.

The record receiving paper sheet must be set around a platen before initiating a printing operation. Such a set operation is manually conducted.

Accordingly, an object of the present invention is to provide a paper guide mechanism which facilitates the paper set operation in a printer.

Another object of the present invention is to provide a novel paper sheet guide mechanism in a printer such as an ink jet system printer and a typewriter.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a paper guide slidable member is slidably disposed under a platen in such a manner to follow the surface of the platen. When the paper setting operation is conducted, the paper guide slidable member is driven to slide forward so that the paper guide slidable member is positioned between the platen and a printer head, thereby ensuring the easy setting of the paper sheet around the platen. When the paper setting operation is completed, the paper guide slidable member is driven to slide backward so that the paper guide slidable member is located below the platen so as not to disturb the printing operation.

BRIEF DESCRIPTION OF THE DRAWINGS

The present invention will be better understood from the detailed description given hereinbelow and the accompanying drawings which are given by way of illustration only, and thus are not limitative of the present invention and wherein:

FIGS. 4 and 5 are schematic sectional views of an essential part of the paper guide mechanism of FIG. 3, wherein FIG. 4 shows a normal operation mode, and FIG. 5 shows an operation mode when a paper sheet is being set in a printer.

DESCRIPTION OF THE PREFERRED EMBODIMENTS

Figure 1:
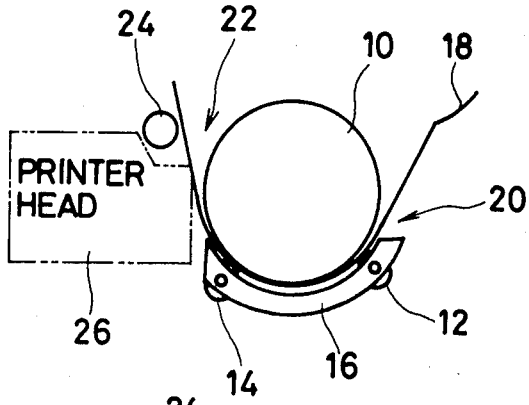
FIG. 1 is a schematic sectional view of a paper guide mechanism of the prior art.
Figure 2:
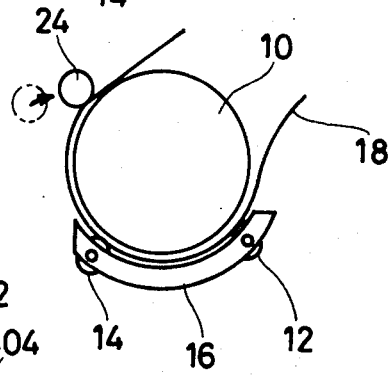
FIG. 2 is a schematic sectional view showing an operation mode of the paper guide mechanism of FIG. 1.

FIGS. 1 and 2 schematically show the paper guide mechanism of the prior art. A platen 10 is rotatably secured in a printer, which is driven to rotate manually or electro-mechanically through the use of a motor.

Paper feed rollers 12 and 14 are rotatably supported by a supporting member 16 which is disposed below the platen 10 so that the paper feed rollers 12 and 14 are depressed against the platen 10 in order to feed a paper sheet 18 from the back (20) of the platen 10 to the front (22) of the platen 10 in response to the rotation of the platen 10 in the clockwise direction in FIGS. 1 and 2. A paper depression roller 24 is disposed in front of the platen 10 in such a manner that the paper depression roller 24 takes either a first position wherein the paper depression roller 24 contacts the surface of the platen 10 or a second position wherein the paper depression roller 24 is separated from the platen 10.

When the setting operation of the paper sheet 18 is conducted, the paper depression roller 24 is separated from the platen 10 as shown in FIG. 1. The paper sheet 18 is inserted between the platen 10 and the paper feed roller 12, and the platen 10 is rotated in the clockwise direction to feed the paper sheet 18 forward. When, the paper setting operation is completed, the paper depression roller 24 is swung to contact the surface of the platen 10 as shown in FIG. 2. Then, the printing operation is conducted onto the paper sheet 18 through the use of a printer head 26.

In such a conventional paper guide mechanism, there is a possibility that the paper sheet 18 bends toward the printer head 26 as shown in FIG. 1. In such a case, the paper setting operation is not well conducted.

Figure 3:
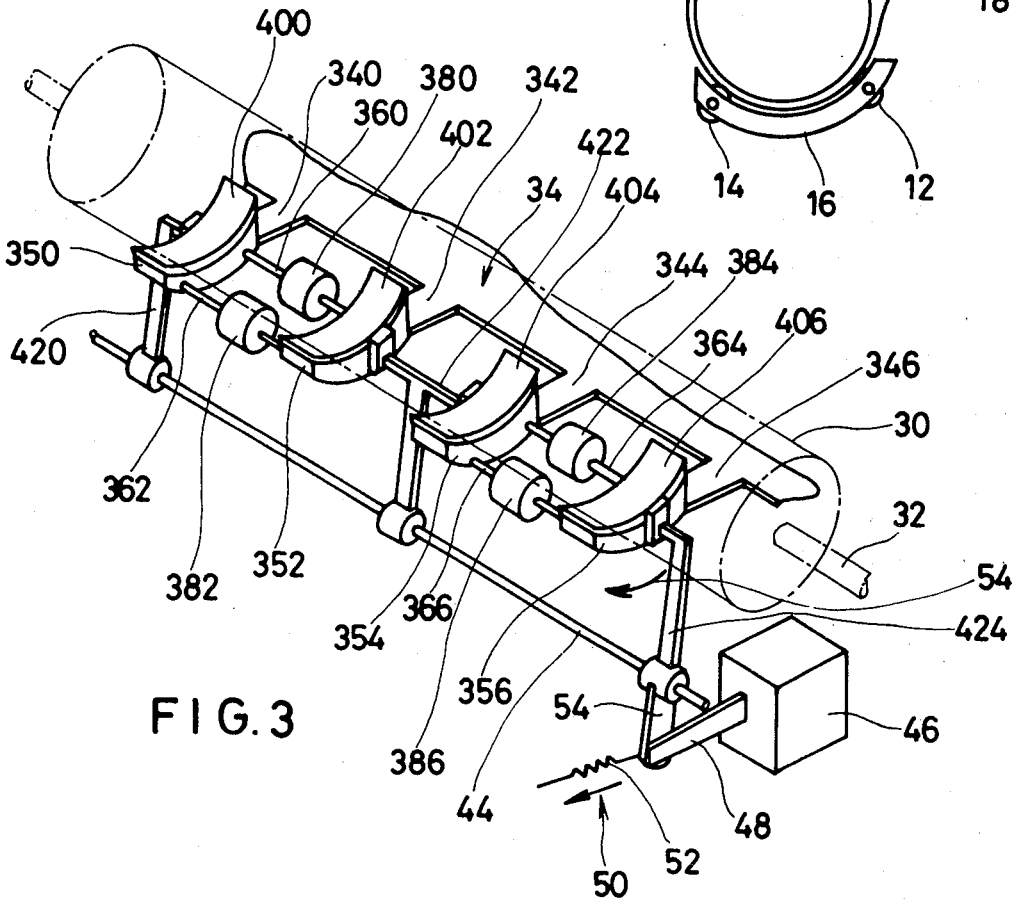
FIG. 3 is a perspective view of an embodiment of a paper guide mechanism of the present invention.

FIG. 3 shows an embodiment of a paper guide mechanism of the present invention.

A platen 30 is shown by a chain line. The platen 30 is mounted on a shaft 32 which is driven to rotate via a platen drive mechanism. The paper guide mechanism of the present invention comprises a supporting member 34 which is secured to the printer body. The supporting member 34 includes a plurality of protruded portions 340, 342, 344 and 346. A plurality of guide base members 350, 352, 354 and 356 are formed at the tip end of each of the protruded portions 340, 342, 344 and 346. The upper surface of each of the guide base members 350, 352, 354 and 356 is shaped to follow the surface of the platen 30.

Two shafts 360 and 362 are extended between the guide base members 350 and 352. Two paper feed rollers 380 and 382 are rotatably mounted on the shafts 360 and 362, respectively. Two other shafts 364 and 366 are extended between the guide base members 354 and 356. Two paper feed rollers 384 and 386 are rotatably mounted on the shafts 364 and 366, respectively. These paper feed rollers 380, 382, 384 and 386 contact the surface of the platen 30 in the normal operation mode at the lower section of the platen 30.

Slidable plates 400, 402, 404 and 406 are slidably disposed on each of the guide base members 350, 352, 354 and 356 to accommodate the surface of the guide base members 350, 352, 354 and 356. The slidable plate 400 is connected to a rod 420. The slidable plates 402 and 404 are connected to a rod 422. The slidable plate 406 is connected to a rod 424. The other end of each of the rods 420, 422 and 424 is secured to a drive shaft 44 which is rotatably secured to the printer body. A solenoid mechanism 46 is provided for sliding the slidable plates 400, 402, 404 and 406 on the guide base members 350, 352, 354 and 356, respectively. A plunger 48 of the solenoid mechanism 46 is pulled in a direction shown by an arrow 50 by means of a spring 52. When the solenoid mechanism 46 is activated, the plunger 48 is attracted in the direction counter to the arrow 52. The plunger 48 is secured to a lever 54 which is secured to the drive shaft 44.

When the solenoid mechanism 46 is activated, the plunger 48 is attracted and, therefore, the tip ends of the rods 420, 422 and 424 are rotated around the drive shaft 44 in the direction shown by an arrow 54. In response to this rotating movement, the slidable plates 400, 402, 404 and 406 slide on the guide base members 350, 352, 354 and 356, respectively, toward the front portion of the platen 30. The activation of the solenoid mechanism is preferably correlated with the movement of the paper depression roller (see 24 in FIGS. 1 and 2). More specifically, when the paper depression roller is separated from the platen, the solenoid mechanism 46 is activated to shift the slidable plates 400, 402, 404 and 406 toward the front portion of the platen. When the paper depression roller is returned to the normal position to contact the surface of the platen, the solenoid mechanism 46 is deenergized to return the slidable plates 400, 402, 404 and 406 to their normal positions.

Figure 5:
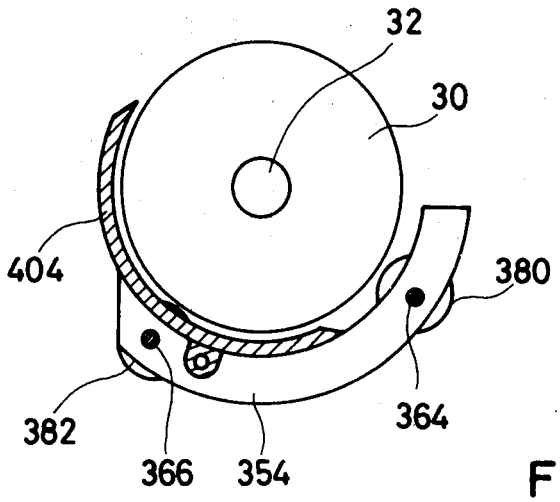

To set the paper sheet, the paper depression roller (24 in FIGS. 1 and 2) is separated from the platen 30. The solenoid mechanism 46 is activated to attract the plunger 48. By this movement, the slidable plates 400, 402, 404 and 406 are shifted on the guide base members 350, 352, 354 and 356 to protrude along the platen 30 as shown in FIG. 5. The paper sheet (18 in FIGS. 1 and 2) is inserted between the platen 30 and the guide base members 350, 352, 354 and 356. Under these conditions, when the platen 30 is rotated, the paper sheet is fed forward by means of the rotation of the platen 30 and the paper feed rollers 380, 382, 384 and 386. The leading edge of the paper sheet slides along the protruded slidable plates 400, 402, 404 and 406 so that the paper sheet is accurately set around the platen 30.

Figure 4:
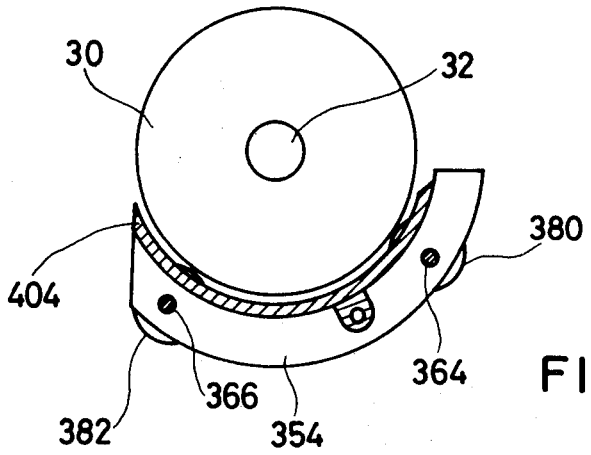

When the setting operation of the paper sheet is completed, the depression roller (24 in FIGS. 1 and 2) is returned to its normal position to contact the platen 30 via the paper sheet. The solenoid mechanism 46 is deenergized and, therefore, the plunger 48 is pulled by the spring 52 in the direction shown by the arrow 50. The rods 420, 422 and 424 are rotated around the drive shaft 44 in the direction counter to the arrow 54. Thus, the slidable plates 400, 402, 404 and 406 are returned to their normal positions as shown in FIG. 4. Accordingly, the slidable plates 400, 402, 404 and 406 do not disturb the actual printing operation conducted by the printer head (26 in FIG. 1).

In the foregoing embodiment, the solenoid mechanism 46 is activated or deenergized in response to the movement of the paper depression roller (24 in FIGS. 1 and 2). However, another control system may be employed. In another preferred form, a detection unit is disposed below the platen 30 for detecting the insertion of the paper sheet into the clearance formed between the platen 30 and the guide base members 350, 352, 354 and 356. In response to the detection output derived from the detection unit, the solenoid mechanism 46 is activated for a preselected period of time.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A paper guide mechanism for guiding a paper sheet around the surface of a platen in a printer, comprising:

at least one paper feed roller disposed below said platen, the axis of said paper feed roller being fixed with respect to the axis of said platen;

at least one guide plate disposed below said platen juxtapositioned to said at least one feed roller, said guide plate being slidably superimposed on a corresponding stationary guide member, the face of said guide plate being shaped to accommodate the surface of said platen while maintaining a predetermined distance therebetween; and shift means for shifting said slidable guide plate relative to said stationary guide member and along the surface of said platen toward the front portion of said platen.

2. The paper guide mechanism of claim 1 comprising at least two guide plates disposed below said platen wherein said feed roller is positioned between said guide plates below said platen.

3. The paper guide mechanism of claim 1, said shift means comprising:

a solenoid mechanism including a plunger;

rod means secured to said slidable guide plate; and transfer means for transferring the shift movement of said plunger to said rod means so that said slidable guide plate is shifted along said surface of said platen when said solenoid mechanism is activated.

4. The paper guide mechanism of claim 3, further comprising:

spring means secured to said plunger of said solenoid mechanism for biasing said rod means so that said at least one slidable guide plate is positioned on said stationary guide member when said solenoid mechanism is deenergized.

* * * * *